US006029869A

United States Patent [19]

Rice

[11] Patent Number: 6,029,869

[45] Date of Patent: Feb. 29, 2000

[54] CLOTHES HANGER

[76] Inventor: Allen Coite Rice, 2003 Sharward Ct., Vidalia, Ga. 30474

[21] Appl. No.: 09/256,460

[22] Filed: Feb. 23, 1999

[51] Int. Cl.[7] ..... A47G 25/30

[52] U.S. Cl. ..... 223/88; 223/96

[58] Field of Search ..... 223/95, 85, 96, 223/93, 91, 88, 90

[56] References Cited

U.S. PATENT DOCUMENTS

| | | | |
|---|---|---|---|
| 2,008,365 | 7/1935 | Oldham | 223/85 |
| 3,760,995 | 9/1973 | Wheeler | 223/85 |
| 3,967,766 | 7/1976 | Hart | 223/85 |
| 4,212,403 | 7/1980 | Zeigler et al. | 223/91 |
| 5,137,191 | 8/1991 | Blanchard et al. | 223/88 |
| 5,277,345 | 1/1994 | Ozaki | 223/98 |

*Primary Examiner*—Bibhu Mohanty
*Attorney, Agent, or Firm*—Gene Scott-Patent Law & Venture Group

[57] ABSTRACT

A common clothes hanger incorporates a scissors type pant clamp comprised of a horizontal rod and a horizontal wire, with the free end of the pant rod having a Velcro® strap attached to it. When a single garment is draped over the pant rod, the rod is engagable within a wire loop for clamping the garment and the strap may be used to assure that the clamp does not open. When multiple garments of significant thickness are draped over the pant rod, the rod is unable to be placed into the wire loop thereby preventing clamping action between the garments and the horizontal wire. Instead the strap is coiled around the wire portion of the scissors type clamp and joined with itself to hold the pant rod and the clamping wire mutually clamped on the garments.

4 Claims, 2 Drawing Sheets

CLOTHES HANGER

BACKGROUND OF THE INVENTION

1. Field of the Invention

This invention relates generally to clothing hangers, and more particularly to a clothes hanger of the scissors clamping type having the ability to adjust for garment thickness.

2. Description of Related Art

Hangers for clothing are well known in the art. Such hangers are made of wood, metal wire and plastic primarily and are used in every home, clothing manufacturer, clothing retailer and hotel. Generally such hangers are constructed with a hook for placing the hanger onto a horizontal rod where it is easily placed and removed as needed. The hook portion generally extends downwardly forming two downwardly divergent edges for resting an article of clothing such as a shirt or jacket wherein the downwardly extending divergent edges extend into the arm sockets of the clothing article. Generally, such a hanger provides a horizontal bar or wire for placing a pant or other garment that is preferably stored by laying over such a bar or wire. Many options are known in such hangers such as the use of clips for hanging a pant by its leg opening from the horizontal bar or wire and the use of clamping bars for holding clothes items from falling from hangers.

The prior art teaches a wide range of clothing hangers. However, the prior art does not teach that a clamp type hanger may be additionally fitted with a clamping strap so that a clamp bar may be infinitely adjusted for applying a selected clamping force onto a garment and so that a wide range of garment thicknesses may be tightly clamped as desired. The present invention fulfills these needs and provides further related advantages as described in the following summary.

SUMMARY OF THE INVENTION

The present invention teaches certain benefits in construction and use which give rise to the objectives described below.

The present invention provides a common clothes hanger incorporating a scissors type pant clamp comprised of a horizontal rod and a horizontal wire, with the free end of the pant rod having a Velcro® strap attached to it. When a single garment is draped over the pant rod, the rod is engagable within a wire loop for clamping the garment and the strap may be used to assure that the clamp does not open. When multiple garments of significant thickness are draped over the pant rod, the rod is unable to be placed into the wire loop thereby preventing clamping action between the garments and the horizontal wire. Instead the strap is coiled around the wire portion of the scissors type clamp and joined with itself to hold the pant rod and the clamping wire mutually clamped on the garments.

A primary objective of the present invention is to provide a clothes hanger having advantages not taught by the prior art.

Another objective is provide such a hanger able to hold one or more garments on a pant rod.

A further objective is to provide such a hanger able to hold, by clamping action, a single garment on a pant rod with a Velcro® strap securing the rod in a locked position on a wire loop.

A still further objective is to provide such a hanger able to hold multiple garments on a pant rod by clamping action when the rod is unable to be locked into the wire loop and such that a selected clamping force may be achieved.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
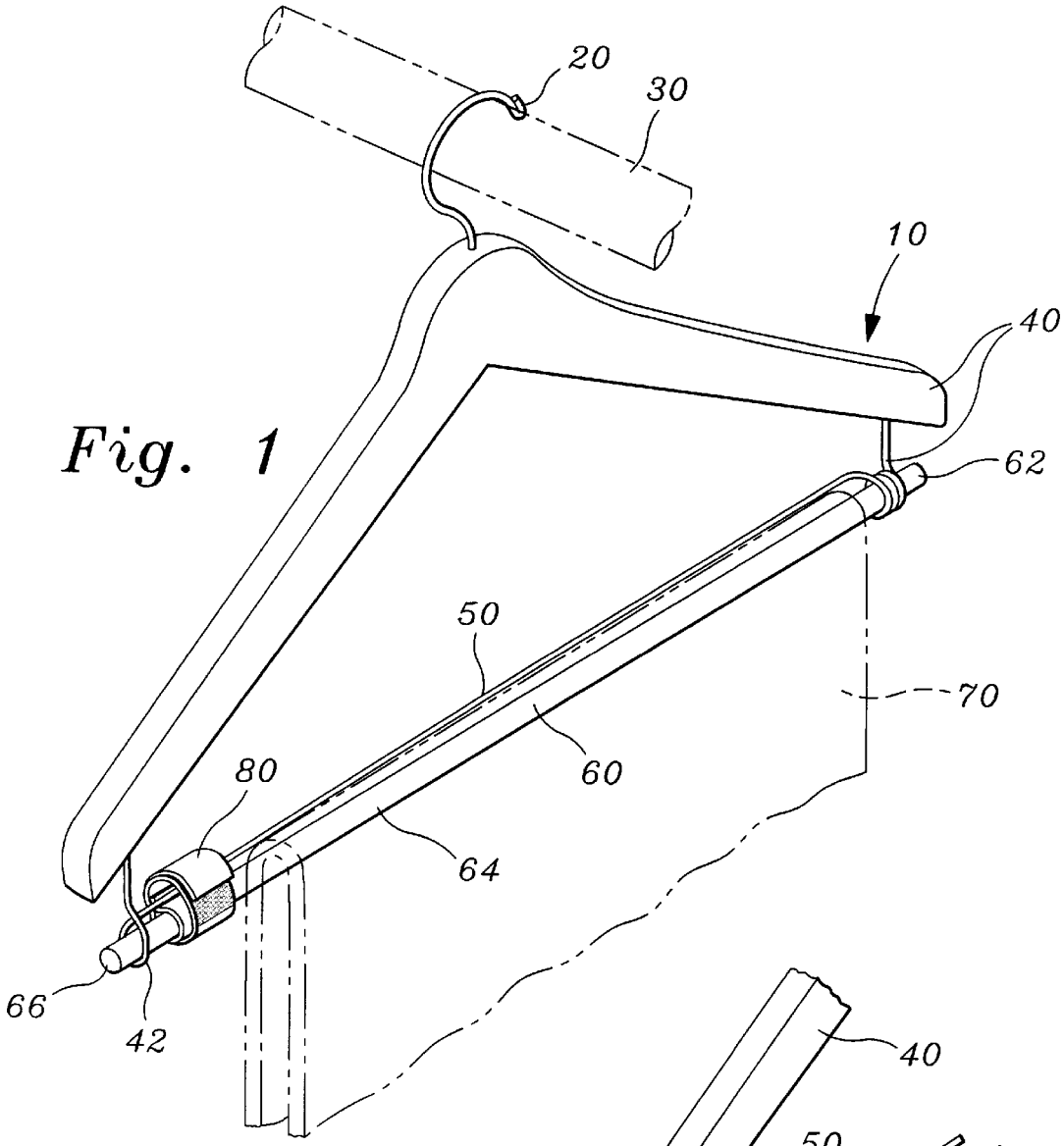
FIG. 1 is a perspective view of the preferred embodiment of the present invention showing the invention in use with a single garment.
Figure 2:
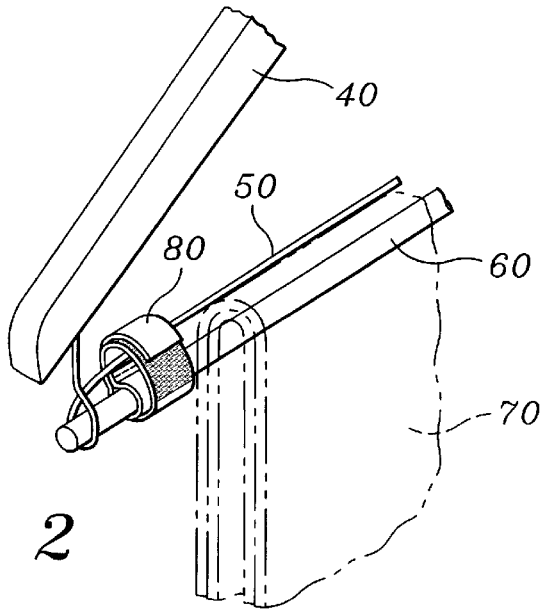
FIG. 2 is a partial view of FIG. 1 showing the invention in use with multiple garments.
Figure 3:
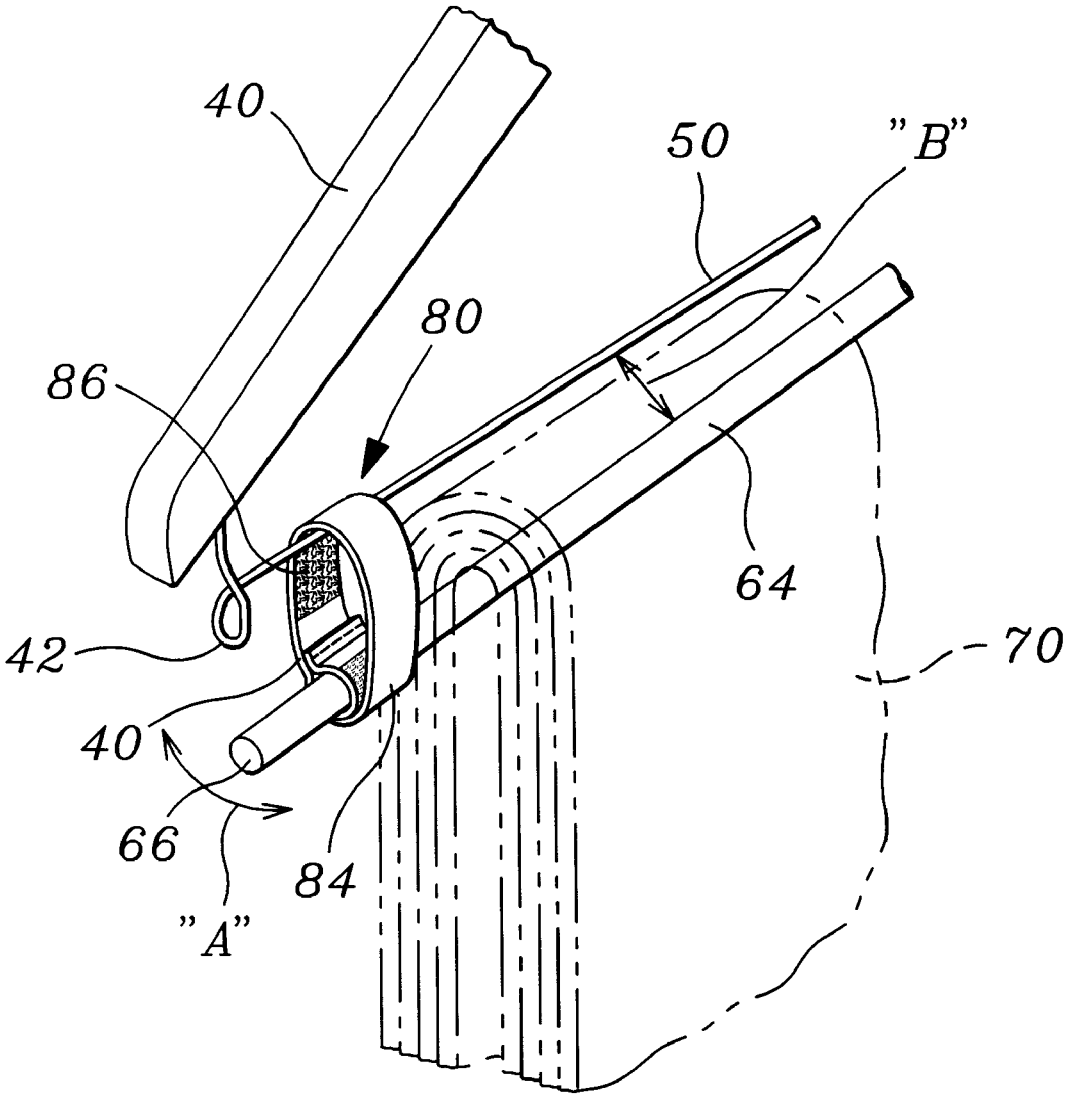
FIG. 3 is a partial view of FIG. 1 showing the invention in use with many garments wherein a Velcro® strap is used to clamp the garments.

The above described drawing figures illustrate the invention, a clothes hanger apparatus 10 similar in certain constructional and operational aspects to certain clothes hangers in common use, the invention comprising: a means for hooking 20 so as to hang the apparatus from a clothes hanger bar 30 (not a part of the invention) as is well known; a clothing support structure 40 engaged with the hooking means 20 and extending downwardly therefrom, the preferred configuration of which being clearly shown in FIG. 1, to provide an elongate, horizontally disposed first clamping surface 50 preferably a wire as shown in FIGS. 1–3, and aligned therewith, an elongate clothing support rod 60, horizontally disposed and held at one end 62 thereof by the clothing support structure 40 preferably by looped wire coils therearound, for supporting a garment 70 draped thereover; the clothing support rod 60 providing a second clamping surface 64, the first and second clamping surfaces 50, 64 positioned in approximate parallel juxtaposition; the clothing support structure 40 further providing a looped support portion 42 near an other end 66 of the elongate rod 60 for removably engaging the other end 66 of the elongate rod 60; the one end 62 of the elongate rod being preferably fixedly joined with the clothing support structure 40 in such a manner as to enable the elongate support rod 60 to swing (see arrow "A" in FIG. 4) into and out of the looped support portion 42 for mounting and clamping the garment 70 respectively; and a flexible strap 80 fixed at a first strap end 82 thereof to the elongate rod 60 preferably by a bonding agent or similar, adjacent said other end 66, the flexible strap 80 having such length so as to be able to be coiled therefrom about the horizontally disposed first clamping surface 50 with a free second strap end 84 removably attachable to the first strap end 82 so as to adjust the spacing "B" between the clamping surfaces 50 and 64. Such attachment of the strap ends 82, 84 may be accomplished by any common fastener such as fabric snaps or clips, but is preferably inventively enabled by a hook and loop fastener material such as Velcro® 86 so that the strap 80 may be tightened into a loop of selected size to provide an infinite adjustment of the strap 80 for accomplishing a custom tightness to the clamping of a given thickness of garment 70 on the clothing support rod 60. Importantly, the strap loop may be fixed whether or not the other end 66 of the support rod 60 is engaged with the looped support portion 42. This clearly provides the advantage of mounting a thicker garment(s) on the invention.

Inventively, the horizontally disposed elongate rod 60 and the first clamping surface 50 are positioned in such juxtaposed adjacency, as seen in FIGS. 1–3, so as to permit the garment or garments 70 to be placed therebetween and thereafter clamped therebetween when the elongate rod 60 is engaged by the looped support portion 42 of the clothing support structure 40.

Inventively, the flexible strap 80 is of such a length as to enable the free second strap end 84 thereof to removably engage the first strap end 82 when the flexible strap 80 is coiled about the first clamping surface 50 and when the elongate rod 60 is disposed away from the looped support portion 42, the flexible strap 80 having such tensile strength as to enable functional clamping of a plurality of garments 70 between the clamping surfaces 50 and 64.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A clothes hanger apparatus comprising:

a means for hooking for hanging the apparatus from a clothes hanger bar;

a clothing support structure engaged with the hooking means and extending downwardly therefrom and providing a horizontally disposed first clamping surface;

a horizontally disposed elongate rod engaged at one end thereof with the clothing support structure for supporting a garment draped thereover;

the first clamping surface positioned in approximate parallel juxtaposition with a second clamping surface of the elongate rod; the clothing support structure further providing a looped support portion adjacent an other end of the elongate rod for positioning the clamping surfaces for clamping the garment;

the other end of the elongate rod being removably positionable within the looped support portion of the clothing support structure and alternately positionable adjacent to the looped support portion; and a flexible strap fixed at a first strap end thereof to the elongate rod adjacent said other end, the flexible strap being coilable therefrom about the first clamping surface with the free second strap end removably fixable to the first strap end.

2. The apparatus of claim 1 wherein the horizontally disposed elongate rod and the horizontally disposed first clamping surface are positioned in such juxtaposed adjacency so as to permit a garment to be placed therebetween and thereafter clamped therebetween when the other end of the elongate rod is engaged by the looped support portion.

3. The apparatus of claim 2 wherein the flexible strap is of such a length as to enable the free second strap end thereof to removably engage the first strap end when the flexible strap is coiled about the first clamping surface and when the elongate rod is disposed away from the looped support portion, the flexible strap having such tensile strength as to functionally clamp a plurality of garments between the first clamping surface and the elongate rod.

4. The apparatus of claim 3 wherein the free second end, and the first end of the flexible strap are joined by a hook and loop fastener material.

* * * * *